US008408034B2

(12) United States Patent
Ishihara et al.

(10) Patent No.: US 8,408,034 B2
(45) Date of Patent: Apr. 2, 2013

(54) HOT BULGE FORMING DIE APPARATUS

(75) Inventors: Yoshimitsu Ishihara, Tochigi (JP); Daisuke Yamamoto, Tochigi (JP); Takayuki Kanou, Tochigi (JP)

(73) Assignee: Honda Motor Co., Ltd., Tokyo (JP)

( * ) Notice: Subject to any disclaimer, the term of this patent is extended or adjusted under 35 U.S.C. 154(b) by 134 days.

(21) Appl. No.: 12/839,894

(22) Filed: Jul. 20, 2010

(65) Prior Publication Data

US 2011/0016947 A1 Jan. 27, 2011

(30) Foreign Application Priority Data

Jul. 21, 2009 (JP) ..... 2009-169830

(51) Int. Cl.
*B21D 39/08* (2006.01)
*B21D 39/20* (2006.01)

(52) U.S. Cl. ..... 72/58; 72/61; 72/62; 29/421.1

(58) Field of Classification Search ..... 72/58, 61, 72/62; 29/421.1
See application file for complete search history.

(56) References Cited

U.S. PATENT DOCUMENTS

| | | | | |
|---|---|---|---|---|
| 4,414,834 | A * | 11/1983 | Gratzer et al. | 72/58 |
| 4,430,872 | A * | 2/1984 | Mihara et al. | 72/51 |
| 5,016,458 | A * | 5/1991 | De Smet | 72/57 |
| 5,339,667 | A * | 8/1994 | Shah et al. | 72/58 |
| 5,557,961 | A * | 9/1996 | Ni et al. | 72/61 |
| 5,649,439 | A | 7/1997 | Schulz | |
| 6,170,309 | B1 * | 1/2001 | Marando | 72/61 |
| 6,182,487 | B1 * | 2/2001 | Komiya et al. | 72/58 |
| 6,912,884 | B2 * | 7/2005 | Gharib | 72/58 |
| 7,275,781 | B2 * | 10/2007 | Wakefield | 296/102 |
| 7,661,283 | B2 * | 2/2010 | Hori et al. | 72/58 |
| 7,669,450 | B2 * | 3/2010 | Friedman et al. | 72/60 |
| 7,941,907 | B2 * | 5/2011 | Yang et al. | 29/419.2 |
| 2005/0029714 | A1 | 2/2005 | Miyanaga et al. | |

FOREIGN PATENT DOCUMENTS

| | | |
|---|---|---|
| JP | 2001150048 | 6/2001 |
| JP | 2003088927 | 3/2003 |
| JP | 2003126923 | 5/2003 |

* cited by examiner

*Primary Examiner* — Bena Miller
(74) *Attorney, Agent, or Firm* — Rankin, Hill & Clark LLP

(57) ABSTRACT

A hot bulge forming die apparatus forms a preheated tubular material 10*a* into a tubular material 10*d*. The hot bulge forming die apparatus includes a lower die 21B having a cavity surface 211B and an upper die 31B having a cavity surface 311B. An elongated hole 215 is formed in a circumferential edge portion 215 of the lower die 21B so as to extend outwards, and a projection 315 is formed on a circumferential edge portion 314 of the upper die 31B so as to fit in the elongated hole 215. When the dies are clamped together, the projection 315 formed on the circumferential edge portion 314 of the upper die 31B fits in the elongated hole 215 formed in the circumferential edge portion 214 of the lower die 21B.

2 Claims, 9 Drawing Sheets

(a)

(b)

(c)

(d)

HOT BULGE FORMING DIE APPARATUS

BACKGROUND OF THE INVENTION

1. Field of the Invention

The present invention relates to a hot bulge forming apparatus and more particularly to a hot bulge forming die apparatus for forming a pre-heated tubular workpiece.

2. Related Art

Conventionally, there has been known a hot bulge forming process in which high-pressure air is supplied into a tubular workpiece disposed between dies so as to form the tubular workpiece into a shape of a cavity defined between the dies.

Specifically, in this hot bulge forming process, for example, a tubular workpiece is preheated, and the tubular workpiece so heated is disposed between a pair of dies. Next, the dies are clamped together while the workpiece is restrained at both lengthwise ends thereof, and high-pressure air is supplied into the tubular workpiece so that the workpiece is pressed against cavity surfaces of the dies. Thereafter, this state is maintained for a certain length of time to cool the workpiece by the dies, whereafter the dies are opened to remove the workpiece so formed from the dies (for example, refer to US2005/0029714).

Here, a projection is formed on a circumferential portion of the cavity surface of one of the dies, while a hole is formed in a circumferential edge portion of the cavity surface of the other die so that the projection fits in the hole with no gap left between the projection and the hole. Then, when clamping the dies together, the circumferential edge portions of the dies are joined together so that the projection on the one die fits in the hole in the other die, whereby the circumferential edge portions of the pair of dies are restrained by each other.

Incidentally, when forming workpieces one after another by the hot bulge forming dies, there has been caused a problem that dimensions of workpieces gradually increase until the number of times of forming reaches a certain number of times of forming.

Namely, in the hot bulge forming process, as a result of cooling a formed workpiece by the dies, the temperature of the dies before another forming is started remains much lower than that of a workpiece.

When a workpiece is introduced into the dies to start forming from that state, the dies absorb heat of the workpiece and expand thermally, whereby the dies warp outwards. Consequently, although the circumferential edge portions of the pair of dies are restrained by each other, the circumferential edge portions are offset from each other.

Consequently, since the quantity of heat that the dies absorb from a workpiece every time forming is performed is increased, the degree of deformation of the dies due to warping is gradually increased, and the degree of offset between the circumferential edge portions is also increased.

Thereafter, when the quantity of heat that the dies absorb from a workpiece and the quantity of heat that is emitted from the dies come to be in balance after the forming has been repeated a certain number of times, a difference in temperature between an inside and an outside of the dies becomes constant, and the degree of deformation of the dies becomes constant, whereby the shapes of the dies become stable.

Consequently, after the number of times of forming has reached a certain number of times and the shapes of the dies have been stabilized, the dimensions of the formed products become almost constant. However, the dimensions of the formed products gradually increase until the shapes of the dies become stable, and hence, the dimensions of the formed products do not become constant.

With a view to solving the problem, in the aforesaid hot bulge forming process, there are proposed two approaches.

A first approach is an approach in which the products formed before the shapes of dies become stable are disposed of as defectives, and only the products formed after the shapes of the dies become stable are adopted as proper products. In this case, the dies are designed in consideration of deformation of the dies due to thermal expansion thereof in advance.

With this first approach, however, due to the products formed immediately after the start of forming being disposed of, the production costs are increased.

A second approach is an approach in which thicknesses of dies are increased so as to increase the rigidity thereof to thereby suppress the deformation of the dies due to thermal expansion thereof. With this approach, since the deformation of the dies can be suppressed in an ensured fashion, irrespective of the number of times of forming, the dimensions of the formed products can be made constant.

With this second approach, the dies and peripheral equipment are made large in size, resulting in high production costs.

SUMMARY OF THE INVENTION

One or more embodiments of the invention provide a hot bulge forming apparatus which can suppress an increase in production costs.

In accordance with one or more embodiments of the invention, a hot bulge forming apparatus for forming a preheated tubular workpiece (for example, a tubular material 10*a*, in the exemplary embodiment) into a desired shape (for example, a tubular material 10*d*), is provided with a first die (for example, a lower die 21B) having a cavity surface (for example, a cavity surface 211B) and a second die (for example, an upper die 31B) having a cavity surface (for example, a cavity surface 311B). An elongated hole (for example, an elongated hole 215) is formed in a circumferential edge portion (for example, a circumferential edge portion 214) of the cavity surface of the first die so as to extend in an outward direction (which is perpendicular to an axial direction of the tubular workpiece). A projection (for example, a projection 315) is formed on a circumferential edge portion (for example, a circumferential edge portion 314) of the cavity surface of the second die so as to fit in the elongated hole. When the dies are clamped together, the projection on the circumferential edge portion of the second die fits in the elongated hole in the circumferential edge portion of the first die.

According to the above structure, when the dies are clamped together, the projection on the circumferential edge portion of the second die is fitted in the elongated hole in the circumferential edge portion of the first die. By doing this, when forming is started and the dies are deformed by thermal expansion and an internal pressure within a cavity defined by the dies so clamped, the projection moves to an outer end along the elongated hole and is located in this position. Thereafter, when forming is repeated, since the degree of deformation of the dies due to thermal expansion is increased gradually, although a share taken by thermal expansion in the cause for deformation of the dies varies, by the projection being positioned in the elongated hole, compared with the conventional example, the dimensions of the formed products become stable in a small number of times of forming. Consequently, since the production of defectives can be suppressed without making the dies and their peripheral equipment large in size, an increase in production costs can be suppressed.

In the above structure, an outer end of the elongated hole in the outward direction may be positioned further outwards than a position where the projection is located when the first die and the second die are clamped together in such a state that the first and second dies are deformed due to thermal expansion, and the outer end of the elongated hole may be positioned further inwards than a position where the projection is located when the first die and the second die are deformed due to an internal pressure therein after the first die and the second die are clamped together in such a state that the first die and the second die are deformed due to thermal expansion.

According to this structure, the outer end of the elongated hole is made to be positioned further outwards than the position where the projection is located when the first die and the second die are clamped together in such a state that the first die and the second die are deformed due to thermal expansion and further inwards than the position where the projection is located when the first die and the second die are deformed due to the internal pressure therein after the first die and the second die are clamped together in such a state that the first die and the second die are deformed due to thermal expansion. Consequently, when the projection is fitted in the elongated hole and the first die and the second die are deformed by the internal pressure therein, the projection is brought into abutment with the outer end of the elongated hole to thereby be positioned thereat. Because of this, the positioning accuracy can be increased.

In the above structure, one of the first die and the second die may include a first base portion (for example, a first base portion 312) and a pair of wall portions (for example, wall portions 313) and hence has a U-shape in section, and the other of the first die and the second die may include a second base portion (for example, the cavity surface 211B) which is opposing to the first base portion. An outward rigidity of the wall portions of the one die may be lower than an outward rigidity of the second base portion of the other die.

According to this structure, the outward rigidity of the wall portions of the one die is made lower than the outward rigidity of the second base portion of the other die. Consequently, the degree of deformation of the wall portions of the one die due to the internal pressure becomes larger than the degree of deformation of the second base portion due to the internal pressure. Because of this, the degree of deformation of the one die is made to differ from the degree of deformation of the other die, and the projection is brought into abutment with the elongated hole in a more ensured fashion to thereby be positioned thereat.

According to the embodiments of the invention, when forming is started, the dies are deformed due to thermal expansion and internal pressure, and the projection moves to the outer end along the elongated hole to thereby be positioned thereat. Thereafter, when forming is repeated, since the degree of deformation of the dies due to thermal expansion is increased gradually, although a share taken by thermal expansion in the cause for deformation of the dies varies, by the projection being positioned in the elongated hole, the dimensions of the formed products become stable in a small number of times of forming. Consequently, since the production of defectives can be suppressed without making the dies and their peripheral equipment large in size, an increase in production costs can be suppressed.

Other aspects and advantages of the invention will be apparent from the following description and the appended claims.

DETAILED DESCRIPTION OF THE EXEMPLARY EMBODIMENTS

An exemplary embodiment of the invention will be described by reference to the drawings.

Figure 1:
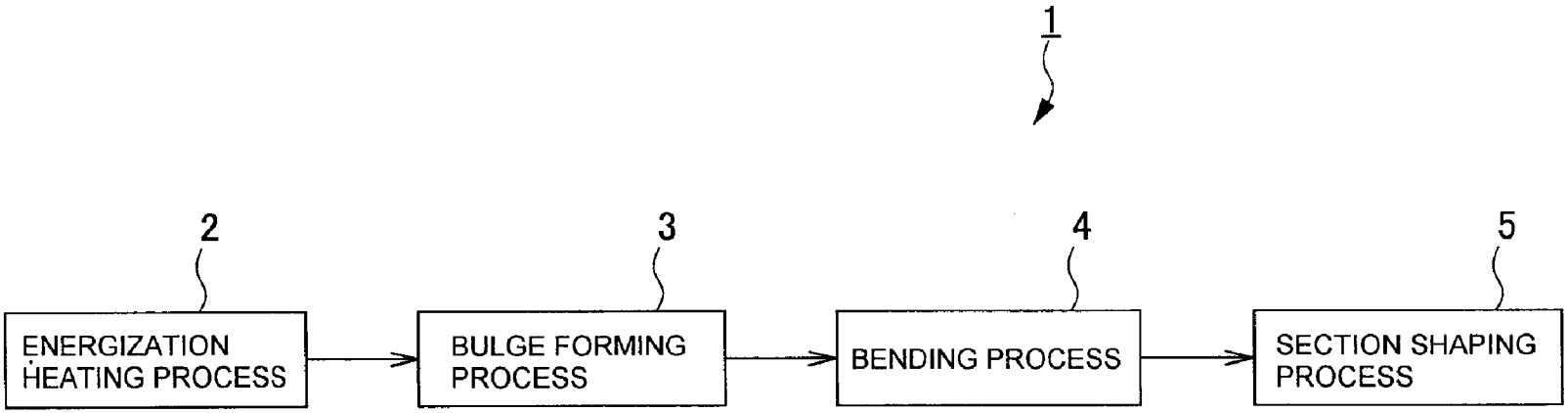
FIG. 1 is a flow chart showing operations of a hot bulge forming apparatus according to an exemplary embodiment of the invention.

FIG. 1 is a schematic block diagram showing operations of a hot bulge forming apparatus 1 to which hot bulge forming die apparatus of the invention are applied.

Figure 2:
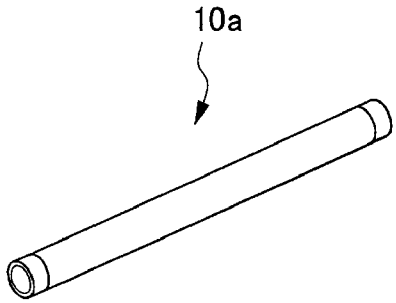
FIG. 2 ((*a*) portion to (*d*) portion of FIG. 2) shows perspective views of workpieces formed by the hot bulge forming apparatus according to the exemplary embodiment.
Figure 2:
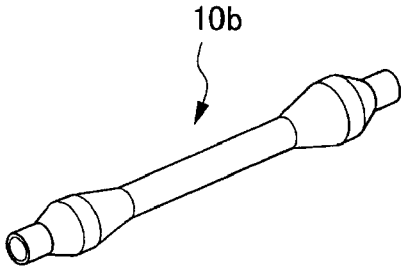
Figure 2:
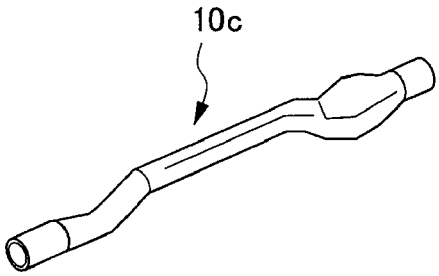
Figure 2:
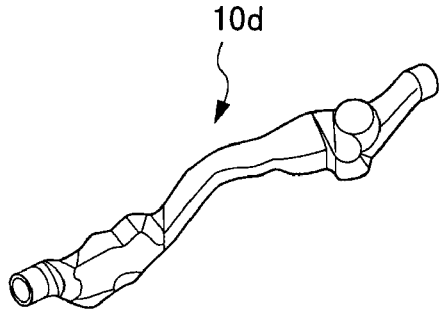

FIG. 2 ((*a*) portion to (*d*) portion) shows perspective views of tubular materials 10*a* to 10*d* which represent workpieces which are formed at respective steps by the hot bulge forming apparatus 1.

The hot bulge forming apparatus 1 is designed to execute an energization heating process 2, a bulge forming process 3 and a bending process 4 which constitutes a pre-forming process, and a section shaping process 5 which constitutes a final forming process sequentially in that order.

Specifically, in the energization heating process 2, a tubular material 10*a*, which is made of an aluminum alloy and which extends substantially rectilinearly, is heated.

In the bulge forming process 3, portions of the tubular material 10*a* which lie closer to ends thereof are expanded by a first bulge forming device 6 (refer to FIG. 3) so as to form the tubular material 10*a* into a tubular material 10*b*.

In the bending process 4, a sectional shape of the tubular material 10*b* is formed into a substantially oval shape and the tubular material 10*b* is curved at an intermediate portion thereof by a second bulge forming device 7 (refer to FIG. 5) so as to form the tubular material 10*b* into a tubular material 10*c*.

In the section shaping process 5, a sectional shape of the tubular material 10*c* is formed into a substantially rectangular shape by a third bulge forming device 8 (refer to FIG. 7) so as to form the tubular material 10*c* into a tubular material 10*d*.

Figure 3:
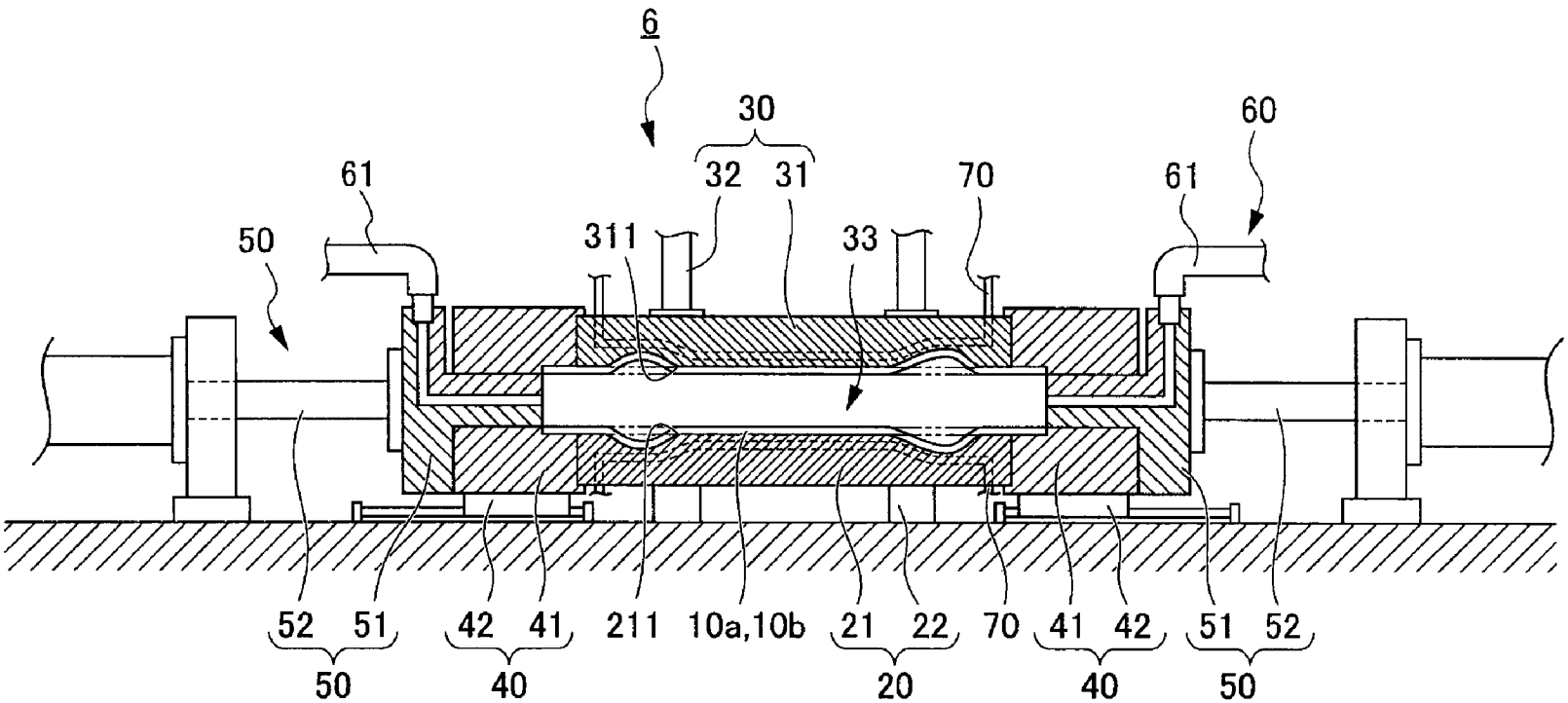
FIG. 3 is a sectional view of a first bulge forming device which makes up the hot bulge forming apparatus.
Figure 4:
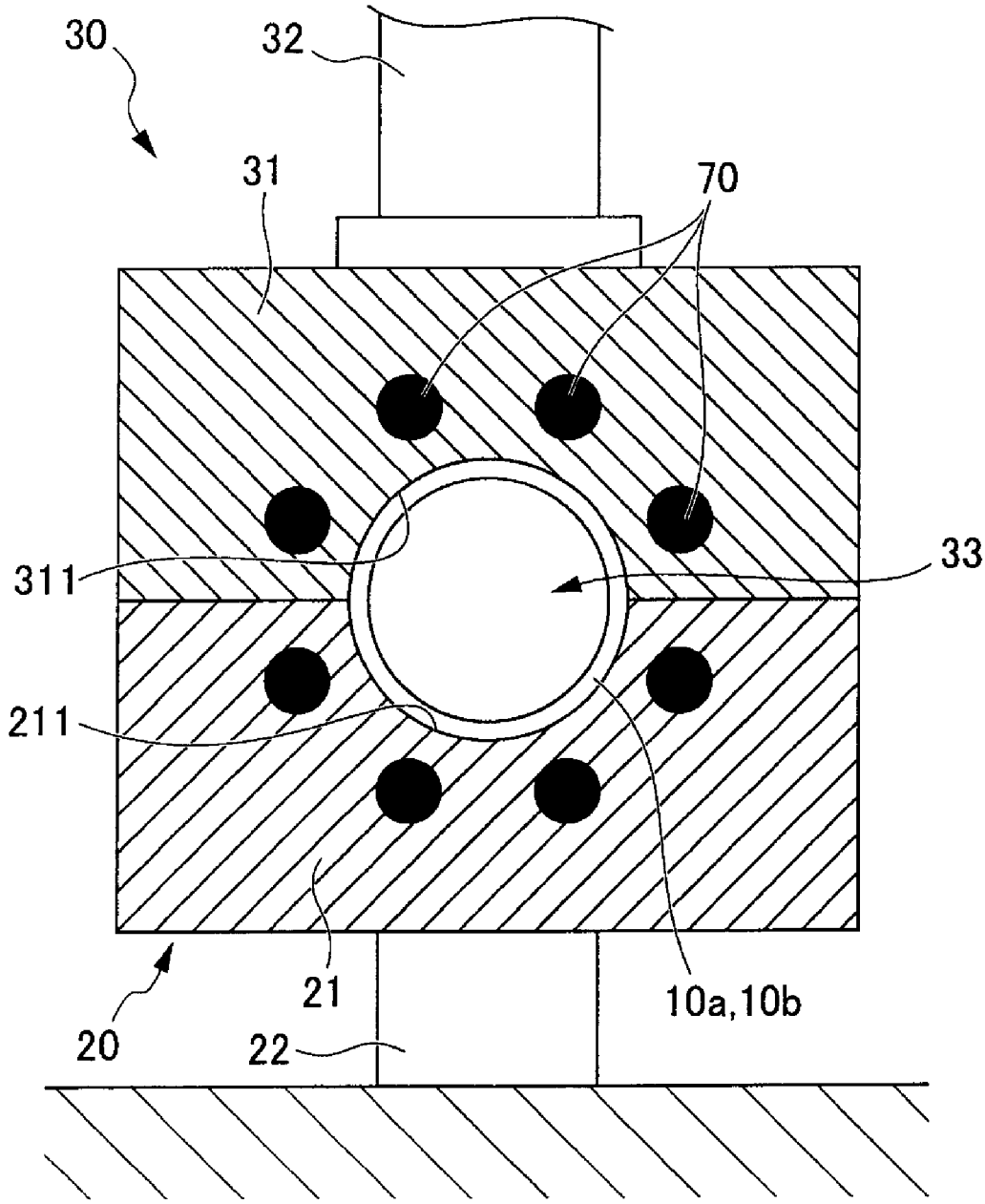
FIG. 4 is a sectional view showing sections of dies of the first bulge forming device.

FIG. 3 is a sectional shape showing a schematic configuration of the first bulge forming device 6. FIG. 4 is a sectional view of dies of the first bulge forming device 6.

The first bulge forming device 6 includes a lower die mechanism 20 which includes a lower die 21 which supports the tubular material 10*a*, an upper die mechanism 30 which includes an upper die 31 which holds the tubular material 10*a* together with the lower die 21 from above and below the tubular material 10*a*, a holding mechanism 40 for holding both end sides of the tubular material 10*a*, a pressing mechanism 50 for pressing both the end sides of the tubular material 10*a* in axial directions, an air supply mechanism 60 for supplying air into an interior of the tubular material 10*a* and heating units 70 for heating the lower die 21 and the upper die 31.

The lower die mechanism 20 includes the lower die 21 as a fixed die and a base 22 which supports the lower die 21. A cavity surface 211 is formed on the lower die 21.

The upper die mechanism 30 includes the upper die 31 as a movable die which is disposed above the lower die 21 so as to confront the lower die 21 and a lifting unit 32 for lifting up and down the upper die 31. A cavity surface 311 is formed on the upper die 31.

When the lifting unit 32 is driven to cause the upper die 31 to approach the lower die 21 so that the upper and lower dies are clamped together, a cavity 33 is defined by the cavity surface 311 of the upper die 31 and the cavity surface 211 of the lower die 21.

The holding mechanism 40 includes a pair of holders 41 which are provided so as to hold the tubular material 10*a* on the lower die 21 from axial directions and reciprocating units 42 for causing the pair of holders 41 to reciprocate along an axial direction of the tubular material 10*a*.

The holder 41 has a substantially cylindrical shape.

The reciprocating units 42 cause the corresponding holders 41 to approach the tubular material 10*a* so as to fit on both the end sides of the tubular material 10*a*, whereby the tubular material 10*a* is held by the holders.

The pressing mechanism 50 includes a pair of pressing members 51 which are inserted individually into the pair of holders 41 and pressing units 52 for causing the pressing members 51 to reciprocate along the axial direction of the tubular material 10*a*.

The pressing units 52 cause the corresponding pressing members 51 to approach the tubular material 10*a* to be inserted individually into the corresponding holders 41 so as to press both ends of the tubular material 10*a* which is held by the holders 41, so that the tubular member 10*a* is compressed towards a center axis direction.

The air supply unit 60 includes air supply lines 61 which pass through the pair of pressing members 51 of the pressing mechanism to reach both the end sides of the tubular material 10*a* and an air pump, not shown, which supplies high-pressure air to these air supply lines 61.

The heating units 70 are incorporated in the lower die 21 and the upper die 31. A high-frequency current heating means, a heater heating unit and the like are raised for use as the heating units 70.

Figure 5:
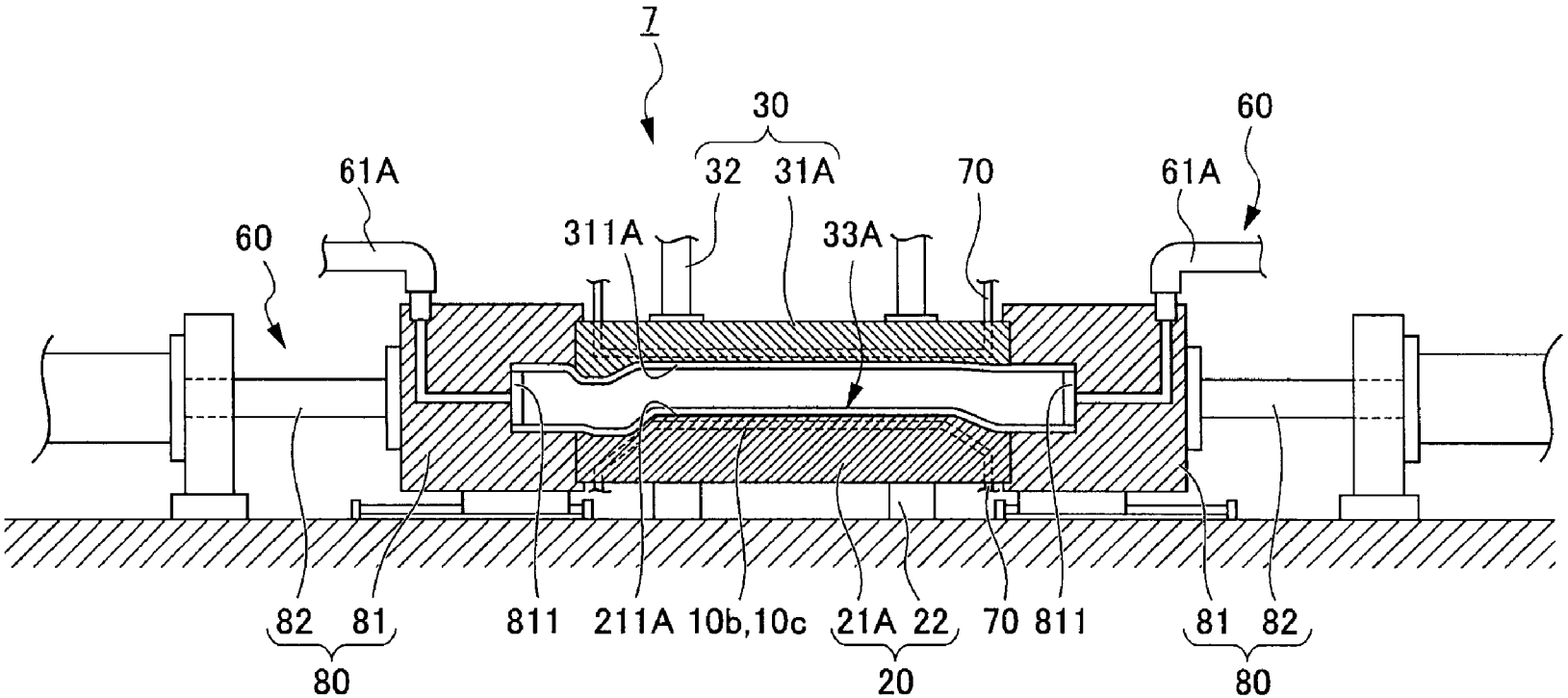
FIG. 5 is a sectional view of a second bulge forming device which makes up the hot bulge forming apparatus.
Figure 6:
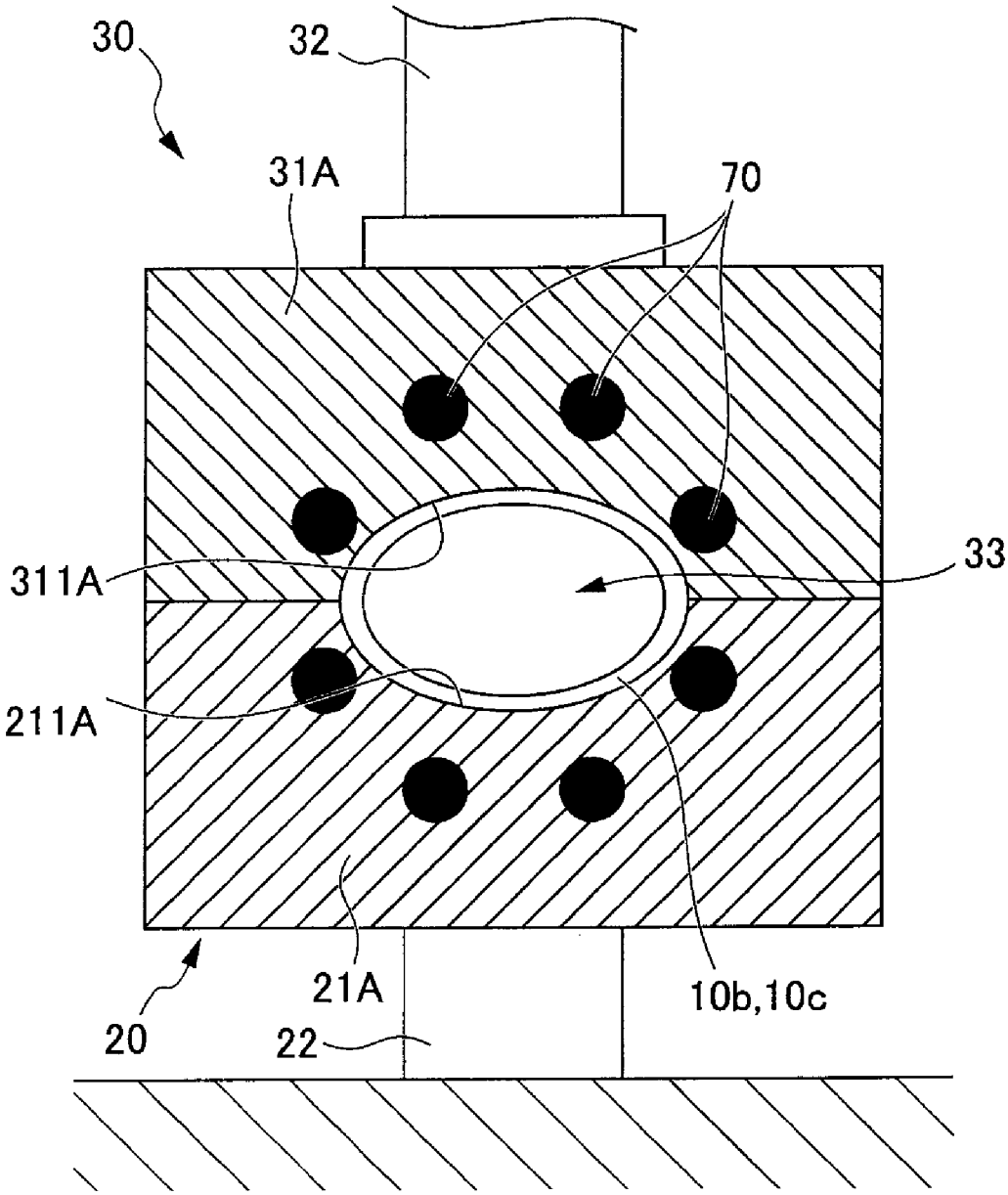
FIG. 6 is a sectional view showing sections of dies of the second bulge forming device.

FIG. 5 is a sectional view showing a schematic configuration of the second bulge forming device 7. FIG. 6 is a sectional view of dies of the second bulge forming device 7.

The second bulge forming device 7 differs from the first bulge forming device 6 in that a cavity 33A defined by a cavity surface 311A of an upper die 31A and a cavity surface 211A of a lower die 21A has a different shape, in that an air supply unit 60 has a different construction, and in that the holding mechanism 40 and the pressing mechanism 50 are not provided but a restraining mechanism 80 is provided. The other configurations of the second bulge forming device 7 are similar to those of the first bulge forming device 6.

Namely, the restraining mechanism 80 includes a pair of restraining beads 81 which are provided so as to hold the tubular material 10*b* on the lower die 21A from axial directions and reciprocating units 82 for causing the pair of restraining beads 81 to reciprocate along an axial direction of the tubular material 10*b*.

A recess portion 811 is formed in the restraining bead 81.

The reciprocating units 82 cause the corresponding restraining beads 81 to approach the tubular material 10*b* so as to allow both end sides of the tubular material 10*b* to fit in the corresponding recess portions 811, whereby the tubular material 10*b* is restrained at both the end sides thereof.

In addition, air supply lines 61A of an air supply unit 60 pass through the pair of restraining beads 81 to reach both the end sides of the tubular material 10*b*.

Figure 7:
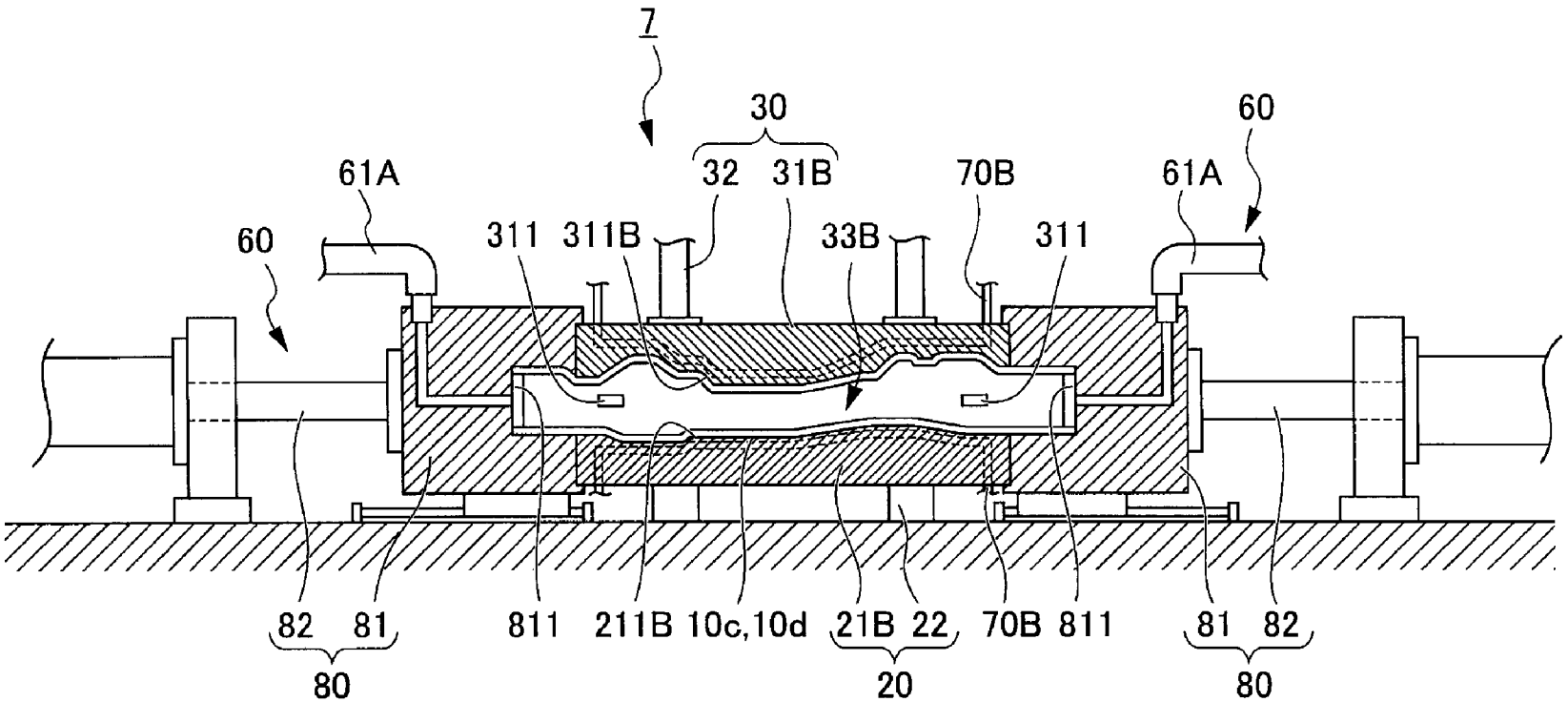
FIG. 7 is a sectional view of a third bulge forming device which makes up the hot bulge forming apparatus.
Figure 8:
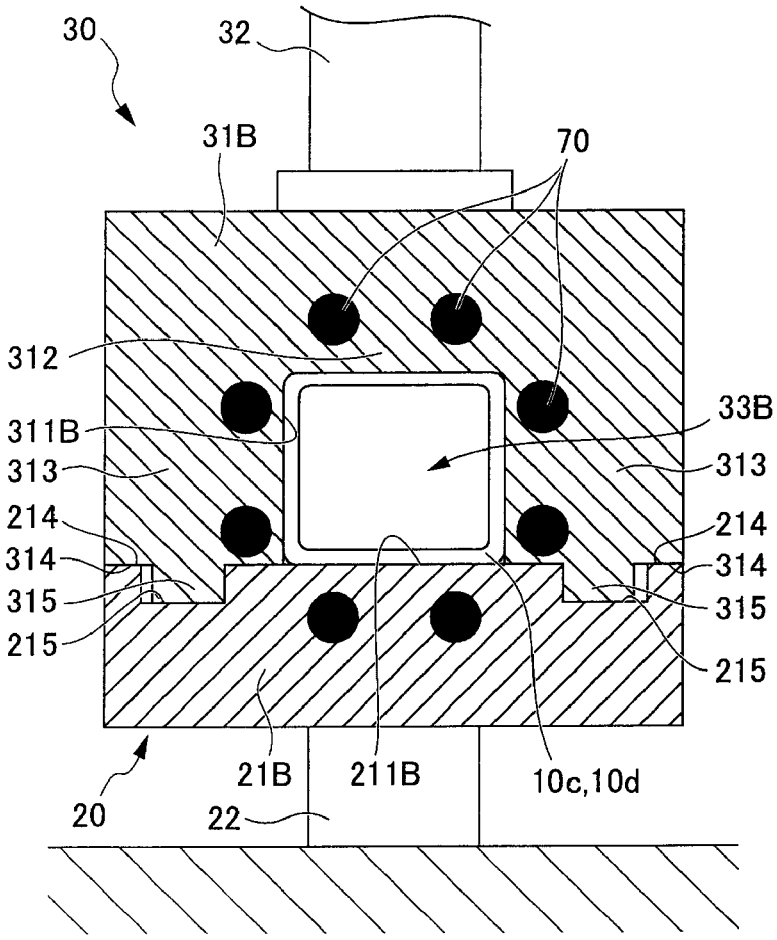
FIG. 8 is a sectional view showing sections of dies of the third bulge forming device.

FIG. 7 is a sectional view showing a schematic configuration of the third bulge forming device 8. FIG. 8 is a sectional view of dies of the third bulge forming device 8.

The third bulge forming device 8 differs from the second bulge forming device 7 in that a first die, a lower die 21B as a second base portion and an upper die 31B as a second die have different shapes, in that a cavity 33B defined by a cavity surface 311B of the upper die 31B and a cavity surface 211B of the lower die 21B has a different shape, and in that heating units 70B have a different configuration. The other configurations of the third bulge forming device 8 remain similar to those of the second bulge forming device 7.

The lower die 21B has a substantially flat plate shape, and the cavity surface 211B is formed thereon. Elongated holes 215 are formed in a lower surface of a circumferential edge portion 214 of the cavity surface 211B so as to extend outwards.

The upper die 31B has a U-like sectional shape and includes a first base portion 312 having a substantially flat plate shape and a pair of wall portions 313 which are provided on the first base portion 312 so as to be erected therefrom while facing each other. An outward rigidity of the wall portions 313 of the upper die 31B is made lower than an outward rigidity of the lower die 21B.

Projections 315 are formed on a circumferential edge portion 314 of the cavity surface 311B of the upper die 31B, that is, distal end faces of the wall portions 313 so as to fit in the corresponding elongated holes 215.

Here, an outer end of the elongated hole 215 is positioned further outwards than a position where the projection 315 is located when the upper die 31B and the lower die 21B are clamped together in such a state that the dies are deformed due to thermal expansion and further inwards than a position where the projection 315 is located when the upper die 31B and the lower die 21B are clamped together in such a state the dies are deformed due to thermal expansion and are then deformed due to internal pressure therein.

For example, a fluid heating means is used as the heating unit 70B.

Hereinafter, a bulge forming procedure by the hot bulge forming apparatus 1 will be described.

A bulge forming process includes a pre-forming process in which a bulge forming process and a bending process are carried out and a final forming process in which a section shaping process is carried out.

Firstly, the tubular material 10*a* which is made of an aluminum alloy is heated to about 500° C. in the energization heating process 2.

Next, the bulge forming process 3 is carried out. Specifically speaking, firstly, the lower die 21 and the upper die 31 are heated to about 500° C., that is, to a recrystallization temperature of the tubular material 10*a* or higher by the heating units 70.

Next, the tubular material 10*a* heated in the way described above is disposed on the lower die 21.

Next, the lifting unit 32 of the upper die mechanism 30 is driven to lower the upper die 31, and the upper die 31 and the lower die 21 are clamped together.

Next, the reciprocating units 42 of the holding mechanism 40 are driven to cause the holders 41 to fit on the end sides of the tubular material 10*a* so as to hold the tubular material 10*a*.

Next, the pressing members 51 of the pressing mechanism 50 are driven, so that the ends of the tubular material 10*a* which is held by the holders 41 are pressed in compressing directions by the pressing members 51. At the same time, the air pump of the air supply unit 60 is driven to supply high-pressure air into the tubular material 10*a*.

Then, hot bulge forming occurs in the tubular material 10*a* in which the tubular material 10*a* is allowed to bulge to follow the configuration of the cavity 33, whereby the tubular material 10*a* is formed into the tubular material 10*b*.

Next, the bending process 4 is carried out. Specifically speaking, firstly, the lower die 21A and the upper die 31A are heated to about 500° C. or the recrystallization temperature of the tubular material 10*b* or higher by the heating units 70.

Next, the tubular material 10*b*, which has been subjected to hot bulge forming, is transferred to be disposed on the lower die 21A by a known transfer means, not shown, while the heating state is maintained.

Next, the reciprocating units 82 of the restraining mechanism 80 are driven to cause the restraining beads 81 to fit on both the end sides of the tubular material 10*b*.

In addition, the lifting unit 32 of the upper die mechanism 30 is driven to lower the upper die 31A, and the lower die 21A and the upper die 31A are clamped together. At the same time, the air pump of the air supply unit 60 is driven to supply high-pressure air into the tubular material 10*b*.

Then, the tubular material 10*b*, which has been subjected to hot bulge forming, is hot bent (at about 500° C.) to follow the configuration of the cavity 33A, whereby the tubular material 10*b* is formed into the tubular material 10*c*.

Next, the section shaping process 5 is carried out. Specifically speaking, firstly, the lower die 21B and the upper die 31B are heated to about 200° C. or the recrystallization temperature of the tubular material 10*c* or lower by the heating units 70B.

Next, the tubular material 10*c*, which has been subjected to bending, is rotated substantially 90° about the a center axis by a rotating means, not shown, and is thereafter transferred to be disposed on the lower die 21B by a known transfer means, not shown.

Next, the reciprocating units 82 of the restraining mechanism 80 are driven to cause the restraining beads 81 to fit on both the end sides of the tubular material 10*c*, whereby the tubular material 10*c* is restrained at both the end sides thereof.

Figure 9:
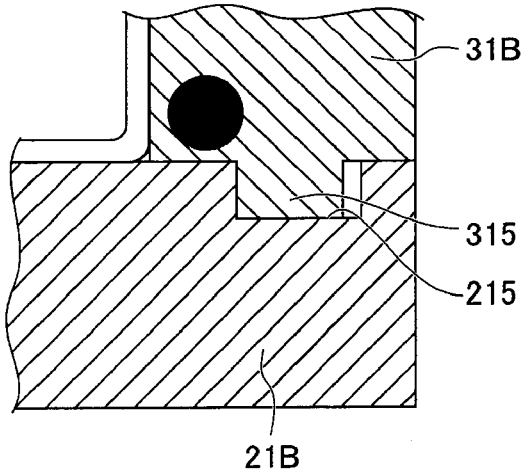
FIG. 9 is a sectional view showing a fitting state between an elongated hole and a projection before start of forming in the third bulge forming device.

In addition, the lifting unit 32 of the upper die mechanism 30 is driven to lower the upper die 31B. Then, the lower die 21B and the upper die 31B are clamped together with the projection 315 fitted in the elongated hole 215 on an inner end side as is shown in FIG. 9. Next, the air pump of the air supply unit 60 is driven to supply high-pressure air into the tubular material 10*c*.

Then, the section of the tubular material 10*c*, which has been subjected to bending, is shaped so as to follow the configuration of the cavity 33B, whereby the tubular material 10*c* is formed into the tubular material 10*d*.

Figure 10:
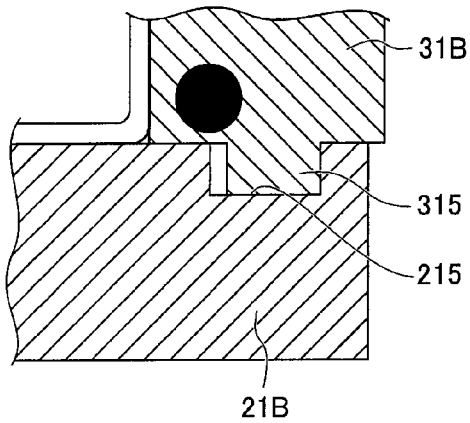
FIG. 10 is a sectional view showing a fitting state between the elongated hole and the projection during forming in the third bulge forming device.

As this occurs, the lower die 21B and the upper die 31B are deformed due to thermal expansion and internal pressure inside the cavity 33B. The outward rigidity of the wall portions 313 of the upper die 31B is made lower than the outward rigidity of the lower die 21B. Because of this, the degree of deformation of the upper die 31B becomes larger than the degree of deformation of the lower die 21B. Then, as is shown in FIG. 10, the projection 315 moves along the elongated hole 215 to an outer end thereof and is positioned thereat.

In this section shaping process, since the temperatures of the lower die 21B and the upper die 31B are about 200° C., the heat of the tubular material 10*c* is conducted to the lower die 21B and the upper die 31B, whereby the temperature of the tubular material 10*c* is decreased. However, hot bulge forming is implemented to some extent.

Thereafter, the temperatures of the lower die 21B and the upper die 31B are held to the recrystallization temperature of the tubular material 10*d* or lower, and the clamping state of the lower die 21B and the upper die 31B is maintained for a certain length of time for cooling the tubular material 10*d*. As this occurs, since the tubular material 10*d* is restrained at both end portions thereof by the restraining beads 81, an axial thermal shrinkage of the tubular material 10*d* is suppressed.

Figure 11:
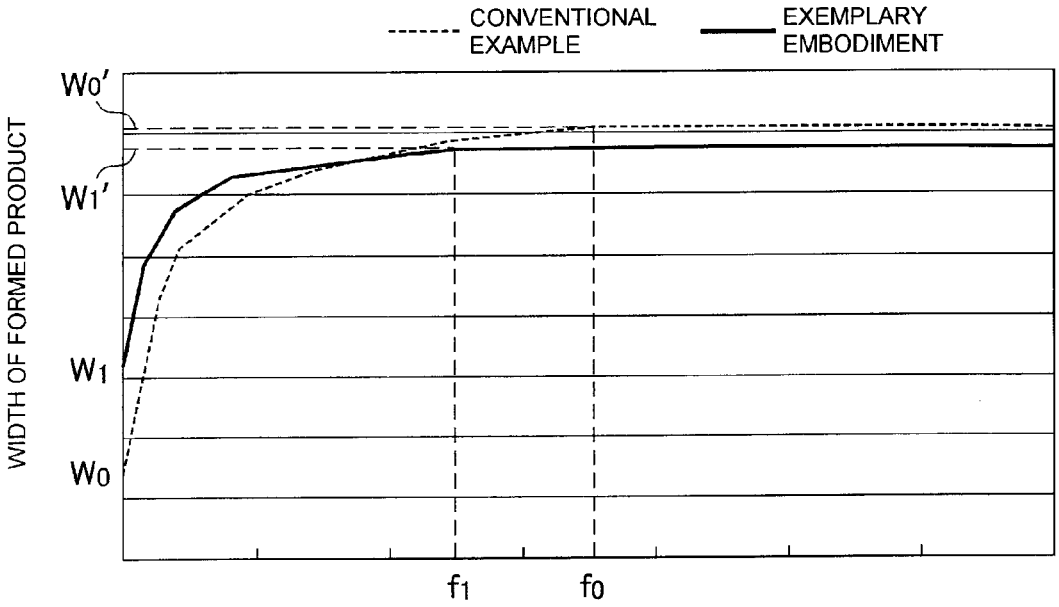
FIG. 11 is a diagram showing a relationship between the degree of deformation of the formed products and the number of times of forming when a section shaping process is repeated one after another by the use of the third bulge forming device.

FIG. 11 is a diagram showing a relationship between widths of the formed products when the section shaping process is repeated one after another and the number of times of forming.

In the conventional hot bulge forming process, a width dimension of a formed product is $W_0$ before start of forming. However, every time forming is repeated, the quantity of heat that the dies absorb from a workpiece is increased. Because of this, the degree of deformation of the dies due to warping is increased gradually. Then, when forming is continuously repeated on the order of $f_0$ times, the quantity of heat that the dies absorb from a tubular material and the quantity of heat that is emitted from the dies come to be in balance, and width dimensions of the formed products become stable at $W_1'$ which is smaller than $W_0'$.

According to the exemplary embodiment that has been described heretofore, the following advantages are provided.

(1) When the dies are clamped together, the projections 315 on the circumferential edge portion 314 of the upper die 31B are fitted in the elongated holes 215 in the circumferential edge portion 214 of the lower die 21B.

Consequently, when forming is started, the upper die 31B and the lower die 21B are deformed by thermal expansion and the internal pressure within the cavity defined by the dies so clamped, and the projections 315 move to the outer ends along the elongated holes and are located in those positions. Thereafter, when forming is repeated, since the degree of deformation of the dies due to thermal expansion is increased gradually, although the share taken by thermal expansion in the cause for deformation of the upper die 31B and the lower die 21B varies, by the projections 315 being positioned in the elongated holes 215, compared with the conventional example, the dimensions of the formed products become stable in a small number of times of forming. Consequently, since the production of defectives can be suppressed without making the dies and their peripheral equipment large in size, an increase in production costs can be suppressed.

(2) The outer end of the elongated hole 215 is made to be positioned further outwards than the position where the projection 315 is located when the lower die 21B and the upper die 31B are clamped together in such a state that the upper and lower dies are deformed due to thermal expansion and further inwards than the position where the projection 315 is located when the lower die 21B and the upper die 31B are deformed due to the internal pressure therein after the lower die 21B and the upper die 31B are clamped together in such a state that the lower die 21B and the upper die 31B are deformed due to thermal expansion.

Consequently, when the projections 315 are fitted in the elongated holes 215 and the lower die 21B and the upper die

31B are deformed by the internal pressure therein, the projections 315 are brought into abutment with the outer ends of the elongated holes 215 to thereby be positioned thereat. Because of this, the positioning accuracy can be increased.

(3) The outward rigidity of the wall portions 313 of the upper die 31B is made lower than the outward rigidity of the lower die 21B. Consequently, the degree of deformation of the wall portions 313 of the upper die 31B due to the internal pressure becomes larger than the degree of deformation of the lower die 21B due to the internal pressure. Because of this, the degree of deformation of the upper die 31B and the degree of deformation of the lower die 21B differ from each other, and the projections 315 are brought into abutment with the elongated holes 215 in a more ensured fashion to thereby be positioned thereat.

While description has been made in connection with specific exemplary embodiment, it will be obvious to those skilled in the art that various changes and modifications may be made therein without departing from the present invention.

For example, in the exemplary embodiment, while the tubular material which takes the forms of tubular materials 10*a* to 10*d* is described as being made of aluminum alloy, the invention is not limited thereto, and hence, the tubular material may be made of other metals.

In addition, in the exemplary embodiment, while air is supplied into the interior of the tubular material which takes the forms of tubular materials 10*a* to 10*d* by the air supply unit 60, the invention is not limited thereto, and hence, other fluids may be supplied thereinto.

DESCRIPTION OF REFERENCE NUMERALS AND SIGNS

10*d* tubular material (workpiece); 21B lower die (second die, second base portion); 31B upper die (first die); 211B cavity surface; 311B cavity surface; 214, 314 circumferential edge portion; 215 elongated hole; 312 wall portion; 315 projection.

What is claimed is:

1. A hot bulge forming die apparatus for forming a preheated tubular workpiece, comprising:

a first die having a cavity surface, wherein an elongated hole is formed in a circumferential edge portion of the cavity surface of the first die, and the elongated hole extends in an outward direction; and a second die having a cavity surface, wherein a projection is formed on a circumferential edge portion of the cavity surface of the second die, and the projection is received in the elongated hole thereby creating circumferential spacing around the projection and allowing for thermal expansion of the first and second die when the first and second die are clamped together, wherein an end of the elongated hole in the outward direction is positioned further outwards than a position where the projection is located when the first die and the second die are clamped together in such a state that the first and second dies are deformed due to thermal expansion, and the outer end of the elongated hole is positioned in a position such that the projection is brought into abutment with the outer end of the elongated hole when the first die and the second die are deformed due to an internal pressure therein after the first die and the second die are clamped together in such a state that the first die and the second die are deformed due to thermal expansion.

2. The hot bulge forming die apparatus according to claim 1, wherein one of the first die and the second die includes a first base portion and a pair of wall portions so as to have a U-shape in section, the other of the first die and the second die includes a second base portion which is opposing to the first base portion, and a rigidity of the wall portions in the outward direction is lower than a rigidity of the second base portion in the outward direction.

* * * * *